US009534844B2

(12) United States Patent
Oikarinen

(10) Patent No.: US 9,534,844 B2
(45) Date of Patent: Jan. 3, 2017

(54) METHOD FOR THE CONTINUOUS SINTERING OF MINERAL MATERIAL AND SINTERING EQUIPMENT

(75) Inventor: Päivi Oikarinen, Kokkola (FI)

(73) Assignee: Outotec Oy, Espoo (FI)

( * ) Notice: Subject to any disclaimer, the term of this patent is extended or adjusted under 35 U.S.C. 154(b) by 562 days.

(21) Appl. No.: 13/813,622

(22) PCT Filed: Sep. 21, 2011

(86) PCT No.: PCT/FI2011/050813

§ 371 (c)(1),
(2), (4) Date: Jan. 31, 2013

(87) PCT Pub. No.: WO2012/038602

PCT Pub. Date: Mar. 29, 2012

(65) Prior Publication Data

US 2013/0130186 A1 May 23, 2013

(30) Foreign Application Priority Data

Sep. 24, 2010 (FI) ..... 20105987

(51) Int. Cl.
*F27B 9/00* (2006.01)
*F27B 21/00* (2006.01)
(Continued)

(52) U.S. Cl.
CPC ..... *F27B 21/00* (2013.01); *C22B 1/205* (2013.01); *C22B 1/26* (2013.01); *F27B 9/30* (2013.01);
(Continued)

(58) Field of Classification Search
USPC ..... 432/13, 11, 18, 77, 164
See application file for complete search history.

(56) References Cited

U.S. PATENT DOCUMENTS 3,245,778 A * 4/1966 Ban ..... 75/759
3,305,226 A * 2/1967 Ziegler et al. ..... 432/78
(Continued)

FOREIGN PATENT DOCUMENTS

CN 101376921 A 3/2009
FI 119940 B1 5/2009
(Continued)

OTHER PUBLICATIONS

International Search Report PCT/FI2011/050813, completed Nov. 25, 2011, mailed Dec. 1, 2011, 4 pages.

*Primary Examiner* — Alissa Tompkins
*Assistant Examiner* — Nathaniel Herzfeld
(74) *Attorney, Agent, or Firm* — Chernoff, Vilhauer, McClung & Stenzel, LLP

(57) ABSTRACT

The invention relates to a method and equipment for the continuous sintering of mineral material in a sintering furnace (S). In the method, a material bed (2) is formed on a conveyor base (1), the material bed (2) is conveyed by the conveyor base (1) through the process zones (I-VII) of the sintering furnace that have different temperatures, the zones including at least one drying zone (I), at least one cooling zone (VII), and at least one other process zone (II, III, IV, V, VI) between the said drying zone and cooling zone, and gas is conducted through the conveyor base and the material bed (2), when the material bed travels through the process zones (I-VII), and gas is circulated in a circulation gas duct (3) from the last cooling zone (VII) to the drying zone (I). Part of the gas flow that is conducted to the drying zone (I) in the circulation gas duct (3) is removed as an exhaust gas flow (B) by the exhaust gas blower (5) of an exhaust gas duct (4). The volume flow of the exhaust gas flow (B) is regulated by regulating the blowing power of the blower (5) to control the
(Continued)

temperature of the gas flow travelling through the material bed in the drying zone.

13 Claims, 1 Drawing Sheet

(51) Int. Cl.

| | |
|---|---|
| ***C22B 1/20*** | (2006.01) |
| ***C22B 1/26*** | (2006.01) |
| ***F27B 21/06*** | (2006.01) |
| ***F27D 7/02*** | (2006.01) |
| ***F27B 9/30*** | (2006.01) |
| ***F27D 9/00*** | (2006.01) |

(52) U.S. Cl.
CPC ..... *F27B 21/06* (2013.01); *F27D 7/02* (2013.01); *F27D 9/00* (2013.01)

(56) References Cited

U.S. PATENT DOCUMENTS

| | | | | |
|---|---|---|---|---|
| 3,849,115 | A * | 11/1974 | Ban | 75/756 |
| 3,871,631 | A | 3/1975 | Biewinga | |
| 4,082,542 | A * | 4/1978 | George | C22B 1/2406 75/641 |
| 4,317,676 | A * | 3/1982 | Souma et al. | 75/756 |
| 4,410,355 | A | 10/1983 | Feichtner et al. | |
| 4,689,007 | A * | 8/1987 | Kilian | 432/14 |
| 5,649,823 | A * | 7/1997 | Tutt | C04B 7/60 110/216 |
| 8,726,537 | B2 * | 5/2014 | Palander | 34/367 |
| 2003/0165789 | A1 * | 9/2003 | Niemela et al. | 432/219 |
| 2011/0143291 | A1 * | 6/2011 | Clements | F23C 9/00 431/9 |

FOREIGN PATENT DOCUMENTS

| | | | |
|---|---|---|---|
| JP | 53054102 | A | 5/1978 |
| JP | 8260062 | A | 10/1996 |
| JP | 9209049 | A | 8/1997 |
| OA | 05830 | A | 12/1977 |
| SU | 970062 | A1 | 10/1982 |
| SU | 1323835 | A1 | 7/1987 |
| WO | 2009030809 | A1 | 3/2009 |

* cited by examiner

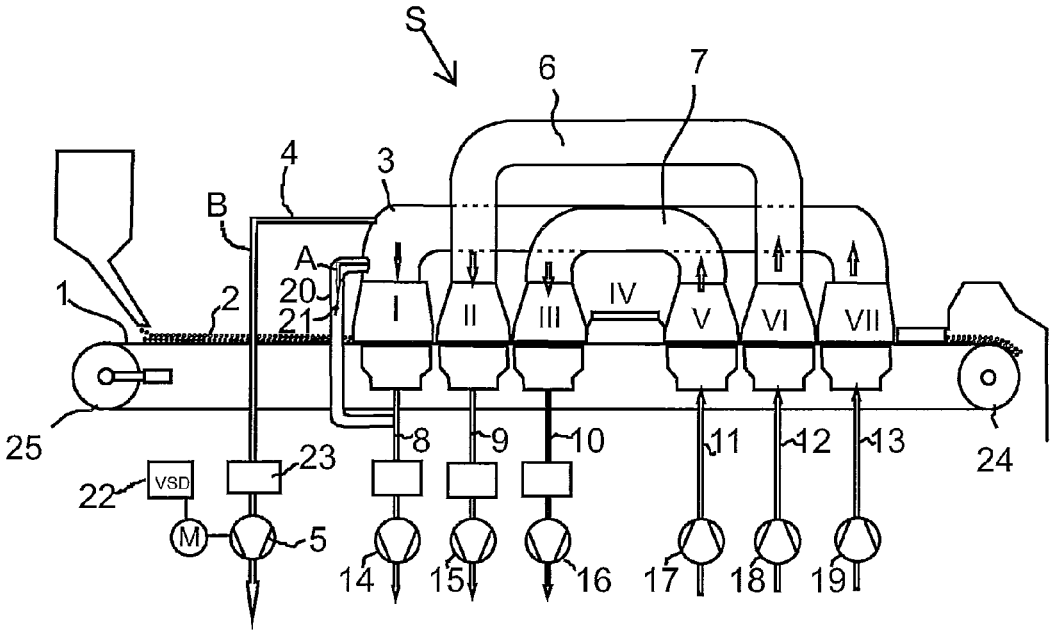
S
6
7
4
3
B
A
20
21
1
2
I
II
III
IV
V
VI
VII
25
8
9
10
11
12
13
24
22
VSD
23
M
5
14
15
16
17
18
19

METHOD FOR THE CONTINUOUS SINTERING OF MINERAL MATERIAL AND SINTERING EQUIPMENT

CROSS-REFERENCE TO RELATED APPLICATION

This is a national stage application filed under 35 USC 371 based on International Application No. PCT/FI2011/050813 filed Sep. 21, 2011, and claims priority under 35 USC 119 of Finnish Patent Application No. 20105987 filed Sep. 24, 2010.

FIELD OF THE INVENTION

The invention relates to a method defined in the preamble of claim 1. The invention further relates to the sintering equipment defined in the preamble of Claim 7.

BACKGROUND OF THE INVENTION

In the continuous sintering of mineral material, a layer of material is formed on a conveyor base in a sintering furnace, the layer being called herein a material bed. The material bed is conveyed by the conveyor base through the process zones of the sintering furnace, which have different temperatures. During the conveyance, gas is conducted through the conveyor base and the material bed when the material bed travels through the process zones.

From a last cooling zone, gas is recycled in a circulation gas duct to a drying zone that constitutes the first process zone. In the drying, the energy of the gas is used for heating the material bed and evaporating water. The gas cools and moistens, when it conveys heat to the evaporation. Exhaust gas conveys moisture away from the material bed. Because of the water transport, it is essential for the balance of the entire furnace that the gas flow through the bed remains constant.

The balance of materials and energy of the well-known sintering furnace is fairly complex due to three separate gas circulation processes from the cooling zones back to the drying, heating, and sintering zones. The process control is based on fixing the process parameters in the entire process, starting from raw material etc., to maintain the balance. The principle of controlling the sintering furnace is not to adjust individual zones at fixed points only, but to balance the temperatures in individual zones to acceptable ranges, so that the profile in the furnace remains in balance.

In prior art solutions, in practice, the drying temperature in the drying zone is controlled by regulating the volume flow of the gas flow that is conducted through the material bed, so that part of the hot gas flow of the circulation gas duct is conducted as a by-pass flow past the material bed and into an exhaust air blower. The regulation is carried out by a control valve that is arranged in the bypass gas duct, which when open, increases the flow and decreases the temperature, and when closed, decreases the flow and increases the temperature in the drying zone.

One problem with the existing system is that, in particular, if and when the change in the position of the control valve is great, it also influences the gas flow through the material bed in the drying zone and, thus, the process itself and the balance of the furnace.

An original and effective principle is to adjust the control valve manually because of the long response times of the control and because of the problem mentioned above. In practice, users have changed the adjustment of the control valve to be automatic, against the instructions. A problem with the automatic use is that it causes variations in the quality of the process and the product. If and when the control valve tries to keep the drying zone temperature at one standard value, the control valve easily fluctuates from side to side. At the same time, it also influences the gas flow through the material bed.

OBJECT OF THE INVENTION

The object of the invention is to eliminate the disadvantages mentioned above.

In particular, the object of the invention is to disclose a method—sintering equipment, by means of which the balance of the sintering furnace is easy to maintain.

Another object of the invention is to disclose a method and equipment, wherein the blower that sucks gas from the drying section through the material bed, and a cleaning device, such as a gas scrubber, can be smaller than before. Also the circulation gas duct that conducts gas from the last cooling zone to the drying zone can be smaller than before.

SUMMARY OF THE INVENTION

The method according to the invention is characterized in what is disclosed in claim 1. The equipment according to the invention is characterized in what is disclosed in claim 7.

According to the invention, in the method, part of the gas flow that is conducted to the drying zone in the circulation gas duct is removed as an exhaust gas flow through an exhaust gas duct, and the volume flow of the exhaust gas flow is regulated to control the temperature of the gas flow travelling through the material bed in the drying zone.

According to the invention, the equipment includes an exhaust gas duct, which is connected to the circulation gas duct that conducts gas from the last cooling zone to the drying zone, to remove part of the gas flow that is conducted in the circulation gas duct as an exhaust gas flow. The equipment further includes an exhaust gas blower, which is arranged in the exhaust gas duct to produce the exhaust gas flow. In addition, the equipment includes a regulating device to regulate the blowing power of the exhaust gas blower to regulate the volume flow of the exhaust gas flow to control the temperature of the gas flow that travels through the material bed in the drying zone.

By means of the invention, the temperature of the drying zone of the sintering furnace is easy to control by regulating the volume flow of the gas that is removed, before the material bed, from the circulation gas duct, which conducts gas from the last cooling zone to the drying zone, by a separate variable-speed exhaust gas blower. Thus the existing blower below the drying zone regulates the gas flow rate through the material bed, and the separate exhaust gas blower controls the temperature of the drying gas. The temperature control can be automated.

In an embodiment of the method, the volume flow of the gas flow that is conducted through the material bed in the drying zone is regulated by conducting part of the gas flow of the circulation gas duct as a by-pass gas flow past the material bed. The volume flow of the by-pass gas flow is set to an essentially constant volume.

Correspondingly, in an embodiment of the equipment, the equipment includes a by-pass gas duct for conducting gas from the circulation gas duct, which conducts gas from the last cooling zone to the drying zone, past the material bed to the exhaust gas duct of the drying zone, and a control valve to regulate the volume flow of the by-pass gas flow in the by-pass gas duct. This by-pass gas duct and control valve that possibly exist in the equipment and are known as such can be left to control the temperature of the exhaust gas in the drying zone to 100° C. to dry the exhaust gas, if necessary, under cold conditions. This, however, does not influence the gas flow through the bed.

In an embodiment of the method, the exhaust gas flow is produced by the exhaust gas blower in the exhaust gas duct, and the volume flow of the exhaust gas flow is regulated by controlling the rotation speed of the exhaust gas blower.

In an embodiment of the method, essentially almost half of the volume flow of the circulation gas duct is removed as the exhaust gas flow.

In an embodiment of the method, dust particles are removed from the exhaust gas flow and the purified exhaust gas flow is conducted into the atmosphere.

In an embodiment of the method, the exhaust gas flow is purified by a cleaning device, such as a gas scrubber.

In an embodiment of the equipment, the equipment includes a cleaning device, such as a gas scrubber, for purifying the exhaust gas flow.

LIST OF FIGURES

In the following, the invention is described in detail by means of an exemplary embodiment and with reference to the appended drawing, wherein the FIGURE presents schematically an embodiment of the sintering equipment, according to the invention.

DETAILED DESCRIPTION OF THE INVENTION

FIG. 1 shows the sintering equipment for the continuous sintering of mineral material, such as ferro-chromium.

The equipment includes a strand sintering furnace S, which comprises a number of sequential process zones I-VII, different temperature conditions prevailing in each one of them when the sintering furnace is running.

The zones include a drying zone I, where the temperature is about 500° C. and where the material is dried, that is, water is removed from the material; a heating zone II for heating the dried material, where the temperature of the material is increased to about 1150° C.; a sintering zone III, where the temperature is about 1350° C. and where the material is sintered; and a balancing zone IV. After the balancing zone IV, there are three sequential cooling zones V, VI, VI, where the sintered material is gradually cooled, so that when leaving the furnace, its temperature is about 400° C.

The belt conveyor 1, which conveys the material bed 2 through the zones mentioned above, is a perforated steel belt, where the perforation allows the gas to pass through. The invention, however, is also useful in connection with a sintering furnace of the so-called moving grate type.

The mineral material to be sintered can be, for example, in a pelletized or some other granular form.

The sintering furnace S functions so that fresh material is fed so as to form a material bed 2 with a thickness of several dozens of centimeters, on top of a steel belt 1 at the forward end of the furnace S (left in the FIGURE). The belt conveyor 1 travels as an endless loop around a creasing roll 25 and a drive roll 24. Above the belt conveyor 8, there are three overhead circulation gas ducts 3, 6, 7, which conduct gas from the cooling zones V, VI, VII to the drying, heating, and sintering zones I, II, III on top of the material bed. Each circulation gas duct 6 and 7 contains a burner (not shown) for heating the gas. Lower exhaust gas ducts 8, 9, 10 that are below the belt conveyor 1 conduct, enhanced by blowers 14, 15, 16, the gas which is conducted through the material bed 2 and the belt conveyor 1, away from the drying, heating, and sintering zones I, II, III. Lower inlet gas channels 11, 12, 13 conduct gas from below the belt conveyor 1 to the cooling zones V, VI, and VII. The movement of gas in the inlet gas channels 11, 12, and 13 is caused by blowers 17, 18, and 19, respectively.

The equipment further includes a by-pass channel 20, through which gas can be conducted from the circulation gas duct 3, which conducts the gas from the last cooling zone VII to the drying zone I, past the material bed 2 and into the exhaust gas duct 8 of the drying zone. The volume flow of the by-pass gas flow is regulated in the by-pass gas channel 20 by adjusting the control valve 21.

The equipment further includes an exhaust gas duct 4, which is connected to the circulation gas duct 3 that conducts gas from the last cooling zone VII to the drying zone I, so that part of the gas flow that is conducted in the circulation gas duct 3 can be removed as an exhaust gas flow B. An exhaust gas blower 5 produces an exhaust gas flow in the exhaust gas duct 4, and a regulating device 22 can regulate the blowing power of the exhaust gas blower 5. By regulating the blowing power, the volume flow of the exhaust gas flow B is regulated to control the gas flow travelling through the material bed in the drying zone and, through that, the temperature of the drying gas that is conducted through the material bed in the drying zone. The blowing power is regulated by regulating the rotation speed of the driving motor M of the exhaust gas blower 5 by a VSD unit (VSD=Variable Speed Drive).

The equipment also includes a cleaning device 23, such as a gas scrubber, to purify the exhaust gas flow B before it is conducted into the atmosphere.

When using the sintering equipment, the volume flow of the gas flow that is conducted through the material bed 2 in the drying zone I is regulated by conducting part of the gas flow of the circulation gas duct 3 as a by-pass flow A past the material bed, and the volume flow of the by-pass gas flow A is set at an essentially standard volume. At the same time, part of the gas flow that is conducted in the circulation gas duct 3 to the drying zone I is removed as the exhaust gas flow B through the exhaust gas duct 4, and the volume flow of the exhaust gas flow B is regulated to control the temperature of the gas flow travelling through the material bed in the drying zone.

The invention is not limited to the application examples described above only, but many modifications are possible within the inventive idea defined by the claims.

The invention claimed is:

1. A method for the continuous sintering of mineral material in a sintering furnace, comprising forming a material bed on a conveyor base;

conveying the material bed by the conveyor base through process zones of the sintering furnace that have different temperatures, the zones including at least one drying zone, at least one cooling zone, and at least one other process zone between the said drying zone and cooling zone; and conducting gas through the conveyor base and the material bed when the material bed travels through the process zones;

circulating gas in a circulation gas duct from the last cooling zone to the drying zone, at least a portion of the circulation gas duct comprising an upper section above the material bed, where part of the gas flow that is conducted toward the drying zone in the upper section of the circulation gas duct is removed as an exhaust gas flow through an exhaust gas duct, and part of the gas flow that is conducted toward the drying zone in the upper section of the circulation gas duct is removed through a bypass channel that bypasses the drying zone, the bypass channel different than the exhaust gas duct; and selectively controlling the temperature and volume of the gas flow traveling through the circulation gas duct and through the material bed in the drying zone whereby said temperature is selectively controlled by varying the rotation speed of an exhaust gas blower in the exhaust gas duct while the volume of the gas flow in the circulation gas duct that is passed to the drying zone is selectively controlled by a regulating device of the bypass channel.

2. The method according to claim 1, wherein the exhaust gas duct connects to the circulation gas duct at a first location and the bypass channel connects to the circulation gas duct at a second location between the first location and the drying zone.

3. The method according to claim 1, wherein half of the volume flow of the circulation gas duct is removed as the exhaust gas flow.

4. The method according to claim 3, wherein dust particles are removed from the exhaust gas flow, and the purified exhaust gas flow is conducted into the atmosphere.

5. The method according to claim 1, wherein the exhaust gas flow is purified by a cleaning device.

6. Sintering equipment for the continuous sintering of mineral material arranged in a material bed, including a sintering furnace, comprising sequential process zones that have different temperature conditions, the zones including at least one drying zone, at least one cooling zone and at least one other process zone between the said drying zone and cooling zone;

a conveyor base for conveying the material bed through the process zones, the conveyor base being gas permeable;

at least one circulation gas duct, at least a portion of which is above the conveyor base, for conducting gas from at least one cooling zone to at least one drying zone and within an upper section of the circulation gas duct that is above the material bed;

output gas channels, which are below the conveyor base, for conducting the gas that exits the process zone and is conducted through the material bed and the conveyor base;

inlet gas channels, which are below the conveyor base, for conducting gas to the cooling zone;

blowers, which are arranged in the output gas channels and the inlet gas channels to produce a gas flow, an exhaust gas duct connected to the circulation gas duct and which conducts gas from the last cooling zone to the drying zone, to remove part of the gas flow conducted in the upper section of the circulation gas duct, as an exhaust gas flow;

a bypass channel that bypasses the drying zone, the bypass channel different than the exhaust gas duct, that removes a part of the gas flow that is conducted toward the drying zone in the upper section of the circulation gas duct;

an exhaust gas blower, which is arranged in the exhaust gas duct to produce the exhaust gas flow; and a first regulating device associated with the exhaust gas duct and capable of selectively controlling the temperature of the gas flow that travels through the circulation gas duct by regulating the blowing power of the exhaust gas blower, and a second regulating device associated with the bypass channel and capable of regulating the volume of the gas flow in the circulation gas duct that is passed to the drying zone.

7. The equipment according to claim 6, where the exhaust gas duct connects to the circulation gas duct at a first location and the bypass channel connects to the circulation gas duct at a second location between the first location and the drying zone.

8. The equipment according to claim 7 wherein the cleaning device is a gas scrubber.

9. The equipment according to claim 6, including a cleaning device for purifying the exhaust gas flow.

10. The equipment according to claim 6, wherein at least one other process zone between the drying zone and the cooling zone comprises a heating zone for heating the dried material bed, a sintering zone for sintering the material, a balancing zone for balancing the temperature of the material bed, and cooling zones for gradually cooling the sintered material bed.

11. The equipment according to claim 6, wherein the material to be sintered consists of pelletized mineral material.

12. The equipment according to claim 6 where the inlet gas channels open into the cooling zone from beneath the conveyor base.

13. The method of claim 1 including the step of introducing cooling gas into the last cooling zone from below and through the material bed.

* * * * *